United States Patent [19]

Schwerin

[11] 4,344,355

[45] Aug. 17, 1982

[54] CONTROL ARRANGEMENT FOR A HYDRAULICALLY OPERATED IMPLEMENT

[75] Inventor: Günter Schwerin, Möglingen, Fed. Rep. of Germany

[73] Assignee: Robert Bosch GmbH, Stuttgart, Fed. Rep. of Germany

[21] Appl. No.: 167,320

[22] Filed: Jul. 10, 1980

[30] Foreign Application Priority Data

Jul. 19, 1979 [DE] Fed. Rep. of Germany ..... 2929232

[51] Int. Cl.[3] ..... F15B 13/042; F15B 13/043

[52] U.S. Cl. ..... 91/445; 91/447

[58] Field of Search ..... 91/445, 447; 251/51

[56] References Cited

U.S. PATENT DOCUMENTS 4,258,610 3/1981 Maucher et al. ..... 91/445

*Primary Examiner*—Irwin C. Cohen

*Attorney, Agent, or Firm*—Michael J. Striker

[57] ABSTRACT

A control arrangement for lifting and lowering a hydraulically operated implement comprises a precontrolled reversing valve and a precontrolled stop block arranged in the fluid pressure stream leading from a source of fluid pressure over the reversing valve to the compartment of a cylinder and piston unit connected to the implement for lifting the latter during feeding of pressure fluid into the compartment and for lowering the implement during discharge of pressure fluid from the compartment. The stop block comprises a releasing piston cooperating with a stop valve of the stop block to alternatingly connect the compartment to a return conduit leading to a tank to discharge pressure fluid from the compartment or to the reversing valve to feed pressure fluid into the compartment. A pressure valve arranged in the releasing piston controls a connection leading from the reversing valve to a damping chamber at one end of the releasing piston which is additionally influenced by the movement of the latter. During sudden reversing of the movement of the implement from lowering to lifting fluid flows from the reversing valve over the pressure valve into the damping chamber and accelerates reversing movement of the releasing piston whereby pressure peaks in the system are avoided.

8 Claims, 2 Drawing Figures

CONTROL ARRANGEMENT FOR A HYDRAULICALLY OPERATED IMPLEMENT

BACKGROUND OF THE INVENTION

A control arrangement for hydraulically operated implements, especially for lifting and lowering an implement arranged on an agricultural vehicle are known in the art and such a control arrangement is for instance disclosed in the German Offenlegungsschrift No. 27 35 559, and which comprises a reversing valve, a stop block in the fluid pressure stream leading to a cylinder and piston unit connected over a linkage to the implement for lifting and lowering the latter, as well as control valves for precontrolling the reversing valve and the stop block. The stop block comprises a stop valve and a releasing piston cooperating therewith, which during lifting of the implement controls a connection from the reversing valve over the releasing piston to the stop valve and which during lowering of the implement controls a connection from the stop valve over the releasing piston to a return conduit. If this known control arrangement is suddenly reversed by actuation of the magnet valves in the precontrol stage from lowering to lifting of the implement connected thereto, then it may happen that the reversing slide of the reversing valve throttles the connection from the pump to the return conduit, whereas the releasing piston has not yet opened the working conduit leading from the reversing valve over the releasing piston and the stop valve to the cylinder and piston unit connected to the implement. If this happens undesirable short pressure peaks will occur which can be relieved only over a pressure limiting valve, whereby the thereby occuring energy losses are likewise of disadvantage.

SUMMARY OF THE INVENTION

It is an object of the present invention to provide a control arrangement of the aforementioned kind in which undesirable pressure peaks and the therewith connected energy losses are avoided during operation of the control arrangement.

With these and other objects in view, which will become apparent as the description proceeds, the control arrangement according to the present invention for lifting and lowering an implement mainly comprises a cylinder and a piston movable in the cylinder and defining in said cylinder to one side of said piston therein a compartment; linkage means between said piston and said implement for lifting the latter upon feeding of pressure fluid into said compartment and for lowering the implement upon discharge of pressure fluid from the compartment, a source of pressure fluid, a tank, conduit means connecting the source of pressure fluid with the compartment, first valve means in the conduit means operable between a first position passing the pressure fluid from the source through the conduit means and a second position discharging the pressure fluid to the tank, second valve means in the conduit means downstream of the first valve means operable between a first position feeding pressure fluid passed by the first valve means into the compartment to lift the implement and a second position discharging pressure fluid from the compartment to the tank to lower the implement, and means coordinated with the second valve means to prevent during sudden shifting of the latter from the second to the first position pressure peaks and energy losses in the arrangement.

The aforementioned conduit means may comprise an inlet conduit leading from the source of pressure fluid to the first valve means, a working conduit leading from the first valve means to the second valve means and a consumer conduit leading from the second valve means to the compartment. The arrangement includes further a discharge conduit leading from the first valve means to the tank and a return conduit leading from the second valve means likewise to the tank. The first valve means may comprise a reversing valve having a reversing slide movable between a first position connecting the inlet conduit to the working conduit and a second position connecting the inlet conduit to the discharge conduit, whereas the second valve means preferably comprise a releasing valve and stop valve downstream of the releasing valve and coordinated therewith, the releasing valve has a damping chamber at one end and a control chamber at the other end thereof and further includes a releasing piston movable between a first position permitting flow of pressure fluid over a section of the working conduit downstream of the releasing valve to the stop valve and from the latter through the consumer conduit to the compartment and a second position connecting the consumer conduit to the return conduit. The arrangement includes further first and second control valve means respectively connected to the reversing and the releasing valves for controlling movement of the same between the positions thereof.

The aforementioned pressure peak preventing means preferably comprise passage means connecting a portion of the working conduit upstream of the releasing valve with the damping chamber of the latter and a pressure valve in this passage means controlled in dependence on the pressure prevailing in the working conduit upstream of the releasing valve.

The releasing valve has adjacent the damping chamber an outlet chamber and the releasing piston has a first piston section arranged to connect in the first position of the releasing piston, in which the stop valve is separated from the return conduit and connected to the upstream section of the working conduit, the damping chamber with the outlet chamber and to interrupt in a position adjacent the second position of the releasing piston the connection between the chambers and in which an additional throttle connection is provided between the chambers and in which the aforementioned passage means in the first position is separated from the upstream section of the working conduit. This arrangement permits a dampened movement of the releasing piston in one of its end positions as well as avoidance of pressure peaks during sudden reversing of the movement of the implement from lowering to lifting. This arrangement has the further advantage that in the neutral position of the control arrangement and during idling of the pump constituting the source of pressure fluid no pressure fluid can pass over the pressure valve into the return conduit so that at the start of the lowering procedure sufficient pressure for movement of the various pistons will be available.

An especially advantageous arrangement is obtained when according to the present invention the aforementioned passage means and the pressure valve are arranged in the releasing piston.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENT

Figure 1:
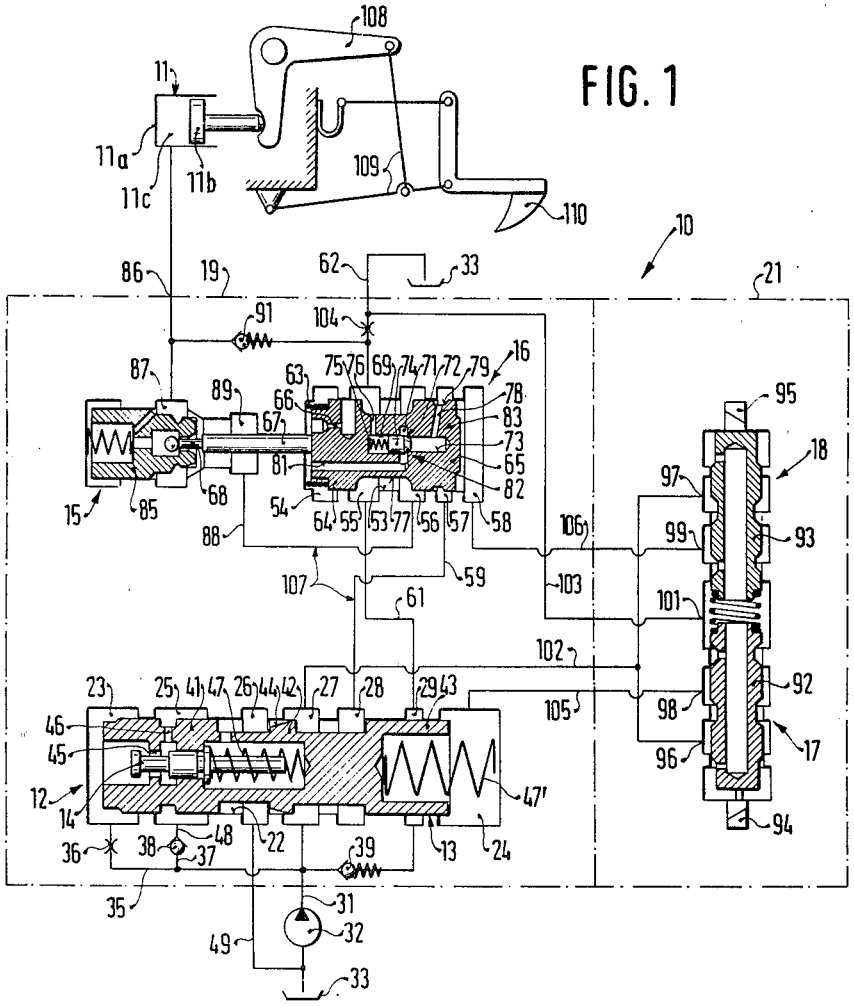
FIG. 1 schematically illustrates the control arrangement according to the present invention with the various elements of the arrangements shown shortly after reversing of the movement of the implement from a lowering to a lifting movement.

FIG. 1 schematically illustrates a control arrangement 10 which is used as an electromagnetically controlled regulating valve for controlling a pressure fluid operated lifter 11 which may be mounted on a tractor. The control arrangement 10 mainly comprises first valve means constituted by a reversing valve 12 having a reversing slide 13 and a control slide 14 arranged in a bore of the reversing slide 13, a stop valve 15 having the function of a one-way valve and of a lowering valve and a releasing valve having a releasing piston 16 coordinated with the stop valve which has an additional control function, and a first precontrol valve 17 coordinated with the reversing valve 12 and a second precontrol valve 18 coordinated with the releasing piston 16. The releasing valve with the releasing piston 16 and the stop valve 15 form together second valve means or a stop block 19, whereas the two precontrol valves 17 and 18 form together a precontrol stage 21.

The reversing slide 13 is arranged in a bore 22 of the reversing valve 12 and the bore 22 has at opposite ends radially enlarged portions forming a first control chamber 23 and a second control chamber 24. Between these two chambers are, subsequent to the first control chamber 23, a third control chamber 25, an outlet chamber 26, an inlet chamber 27, a consumer chamber 28 and a relief chamber 29. The inlet chamber 27 is connected by an inlet conduit 31 with a pump 32 forming a source of pressure fluid and sucking pressure fluid, for instance oil, from a tank 33. A first control conduit 35 leads from the inlet conduit 31 over a throttle 36 to the first control chamber 23. The first control conduit 35 is further connected through a control channel 37, in which a one-way valve 38 is arranged with the third control chamber 25, so that the throttle 36 and the one-way valve 38 are connected in parallel with each other. The inlet conduit 31 is further connected through a conduit in which a pressure limiting valve 39 is arranged with the relief chamber 29. The reversing slide 13 has three sections 41, 42 and 43 of which the second, that is the intermediate section, has a fine control chamfer 44. The first section 41 of the reversing slide has a coaxial longitudinal bore 45 in which the control slide 14 is guided. The first section 41 has a transverse bore 46 communicating with the longitudinal bore 45 to thus connect the first control chamber 23 with the third control chamber 25, whereby this connection may be closed by the control slide 14. The control slide 14 is held by a spring 47 in the shown rest position. A second spring 47' arranged in the second control chamber 24 engages the reversing slide 13 and biases the latter in the direction towards the first control chamber 23. The transverse bore 46 in the reversing slide 13 forms together with the control channel 37 and the one-way valve 38 therein part of a second control conduit 48 which connects the first control chamber 23 with the inlet conduit 31 in parallel to the first control conduit 35. A discharge conduit 49 leads from the outlet chamber 26 to the tank 33.

Figure 2:
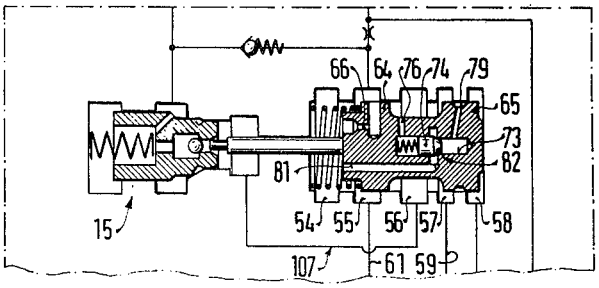
FIG. 2 illustrates a part of the control arrangement according to FIG. 1 at a stopping position of the releasing piston.

The release piston 16 is guided in a bore 53 in which a damping chamber 54, an outlet chamber 55, a forwarding chamber 56, a inlet chamber 57, as well as a control space 58 are arranged adjacent to each other. A consumer channel 59 leads from the inlet chamber 57 to the consumer chamber 28 of the reversing valve 12, whereas the relief chamber 29 of the latter is connected through a relief channel 61 with the outlet chamber 55 at the release piston 16. The outlet chamber 55 is further connected through a return conduit 62 with the tank 33. The releasing piston 16 is biased by compression coil spring 63 arranged in the damping chamber 54 in the direction toward the control space 58. The release piston 16 has a first piston section 64 facing the damping chamber 54 and a second piston section 65 limiting the control space 58. The first piston section 64 closes in its left end position as shown in FIG. 1, the connection between the damping chamber 54 and the outlet chamber 55. In the same position of the release piston 16 are the two chambers 54 and 55 connected to each other over a throttle connection 66 arranged in the first piston section 64. If the releasing piston 16 is in its starting position, as illustrated in FIG. 2, the first piston section 64 is arranged to provide in addition to the throttle connection 66 also a connection between the damping chamber 54 and the outlet chamber 55. A push rod 67 coaxially projects from the first piston section 64 to the stop valve 15 with a pin section 68 of reduced diameter at the free end of the push rod. A first bore 69 in the interior of the release piston 16 passes over an annular chamber 71 under formation of a valve seat 72 into a second coaxial bore 73. A piston shaped closure member 74 is closely guided in the first bore 69 and the closure member 74 has a conical end portion which is biased by a spring 75 against the valve seat 72. The spring receiving portion of the first bore 69 is connected by a transverse bore 76 with a first annular groove 77 formed at the outer periphery of the release piston 16. This annular groove 77 is located between the first piston section 64 and the second piston section 65. A transverse bore 78 leads from the second bore 73 to a second annular groove 79 arranged in the outer periphery of the second piston section 65. An axial bore 81 leads from the annular chamber 71 through the first piston section 64 to the end face of the releasing piston 16 in the damping chamber 54. The closure member 74 is part of a pressure valve 82 located in a connection 83 leading from the second annular groove 79 to the damping chamber 54. The pressure valve 82 and the spring coordinated therewith are constructed to open the connection 83 already at relative low pressure. The releasing piston blocks in its left end position, as shown in FIG. 1 the connection between the inlet chamber 57 to the forwarding chamber 56 whereas the latter is connected to the outlet chamber 55. In this position is the second annular groove 79 connected to the inlet chamber 57. If, however, the releasing piston 16 is in its starting position, as illustrated in FIG. 2, then the forwarding chamber 56 is connected with the inlet chamber 57, whereas the connection between the forwarding chamber 56 to the outlet chamber 55 is interrupted. At the same time the second piston section 65 interrupts in the position of the releasing piston 16 as shown in FIG. 2 the connection between the inlet chamber 57 and the second annular groove 79.

The stop valve 15 has a stepped main valve body 85 which controls the connection between a first chamber 87 communicating with the consumer conduit 86 and a second chamber 89 which over a channel 88 is connected with the forwarding chamber 56 at the releasing piston 16. The stop valve 15 with its ball shaped precontrol member which is arranged between two valve seats and which is actuatable by the pin 68, is known per se. The consumer conduit 86 is connected over a pressure limiting valve 91 to the return conduit 62.

The two precontrol valves 17 and 18 of the precontrol stage 21 are of the same construction and constructed as 3port-2position valves. The spring loaded control slides 92 and 93 thereof are respectively actuatable by electromagnets 94, respectively 95. Each of the precontrol valves 17 and 18 has an inlet port 96 respectively 97, a consumer port 98, respectively 99 as well as a common return port 101. The inlet ports 96 and 97 are connected by a common conduit 102 to the inlet chamber 27 of the reversing valve 12. A conduit 103 leads from the return port 101 to the return conduit 62 to a point of the latter which is downstream of a throttle 104 arranged in the return conduit 62. The consumer port 98 is connected over a conduit 105 to the second control chamber 24 of the reversing valve 12 and the consumer port 99 is connected over a conduit 106 with the control space 58 at the releasing piston 16.

The consumer channel 59, the channel 88 and the consumer conduit 86 form parts of a working conduit leading from the reversing valve 12 over the stop block 19 to the lifter 11. The pressure fluid operated lifter 11 comprises a cylinder **11*a*, a piston 11*b* reciprocatable therein and forming to one side of the piston a compartment 11*c* with which the consumer conduit 86 communicates. The piston 11*b* actuates by means of a piston rod a lifting arm 108 mounted on the non-illustrated tractor and the lifting arm 108 actuates over a known 3-point linkage 109 a plow 110**.

The operation of the control arrangement of the present invention will now be explained, whereby the known function of the control arrangement 10 in the neutral, the lifting and lowering position will be discussed only insofar as is necessary for the proper understanding of the invention.

In the neutral position, which is not illustrated, of the various elements of the control arrangement 10 the two precontrol valves 17 and 18 are not actuated, the second control chamber 24 of the reversing valve 12 and the control space 58 at the releasing piston 16 are relieved over the two precontrol valves 17 and 18 to the tank 33. The oil pumped by the pump 32 is directed by the reversing slide 13 into the discharge conduit 49, whereby due to the force of the spring 47' a smaller neutral circulating pressure is maintained in the inlet chamber 27. The releasing piston 16 which is in its starting position, as shown in FIG. 2 blocks the connection between the consumer channel 59 to the return conduit 62. The lifter 11 is hydraulically blocked by the stop valve 15.

In order to start the lowering procedure (not illustrated) at the lifter 11, the second precontrol valve 18 is actuated. Thereby the control space 58 is connected over the conduit 106, the ports 99 and 97 at the second precontrol valve 18 and the conduit 102 with the inlet chamber 27 of the reversing valve 12. Thereby the neutral circulation pressure can be built up in the control space 58 which moves the releasing piston 16 from its starting position towards the left in its end position. This movement may proceed very fast in the beginning, as long as the first piston section 64 does not close the connection of the damping chamber 54 to the outlet chamber 55. When the first piston section 64 closes this connection, oil must flow from the damping chamber 54 over the throttle connection 66, thereby damping the movement of the releasing piston 16. During its movement towards the left, the releasing piston 16 opens the connection from the forwarding chamber 56 to the outlet chamber 55. At the same time the releasing piston opens with its pin 68 the stop valve 15 in the manner of a follow-up control. Thereby pressure fluid may flow from the compartment **11*c* over the opened stop valve 15, the channel 88, the releasing piston 16 and the return conduit 62 to the tank 33 and during this lowering of the plow 110 the reversing slide 12 reduces the neutral circulation pressure to a pressure which is sufficient for the actuation of the releasing piston 16. During this lowering of the plow 110 the throttle 104 together with the releasing piston 16 will act as a pressure limiting valve whereby a uniform lowering of the lifter 11 independent from the load acting thereon is obtained. The neutral circulation pressure throttled by the reversing slide 13 during the lowering process acts thereby over the consumer channel 59, the inlet chamber 57, the transverse bore 78 and the second bore 73 in the releasing piston onto the closure member 74. Since the pressure valve 82 is adjusted to a pressure which is slightly above the neutral circulation pressure, the closure member 74 will close the connection through 83**.

FIG. 1 illustrates now the situation which occurs shortly after the lifter 11 is suddenly reversed from lowering to lifting of the plow 110. The first precontrol valve 17 actuated by the magnet 94 connects the second control chamber 24 of the reversing valve 12 over the conduit 105, the consumer port 98, the inlet port 96 and the conduit 102 with the inlet chamber 27 of the reversing valve 12. Thereby the neutral circulation pressure will build up in the second control chamber 24 resulting in a pressure equalization between the control chambers 23 and 24. The second spring 47' presses the reversing slide 13 towards the left, as viewed in FIG. 1, whereby pressure fluid may escape unthrottled from the first control chamber 23 over the control slide 14, the transverse bore 46, the third control chamber 25 and the one-way valve 38. The reversing slide 13 is thereby moved relatively fast toward the left by the spring 47', whereby the fine control chamfer 44 throttles the flow of pressure fluid from the pump 32 into the discharge conduit 49. Whereas the reversing valve 12 acts relatively fast, the releasing piston 16 has moved shortly after reversing not far from its left end position. The spring 63 in the damping chamber 54 tries to move the releasing piston towards the right in its starting position as shown in FIG. 2. Thereby pressure fluid can flow from the control space 58 over the conduit 106, the non-actuated second precontrol valve 18 and the conduit 103 into the return conduit 62. During this movement of the releasing piston towards the right, pressure fluid will be sucked from the outlet chamber 55 over the throttle connection 66 into the damping chamber 54, as long as the first piston section 64 closes the connection between these two chambers. At the same time, the second piston section 65 of the releasing piston 16 interrupts in the position shown in FIG. 1 the working conduit 107. If now the fluid pressure is increased by the fine control chamfer 44 to a pressure which surpasses the usually low neutral circulation pressure, this increased pressure will act over the consumer channel 59 also in the inlet chamber 57 and over the cross bore 78 onto the closure member 74 of the pressure valve 82. The pressure valve 82 opens at relatively low pressure which is slightly greater than the neutral circulation pressure, and lets the pressure fluid flow over the axial bore 81 into the damping chamber 54. Thereby the movement of the releasing piston 16 from its left end position towards the right is accelerated. In this way the pressure in the system can practically not increase beyond a predetermined value determined by the pressure valve 82. If this would not occur, this would lead only to a still faster movement of the releasing piston towards its starting position. Thereby, in any case the connection of the forwarding chamber 56 to the outlet chamber 55 will be closed and the connection between the forwarding chamber 56 and the inlet chamber 57 will be opened. If now the releasing piston 16 reaches its starting position, as illustrated in FIG. 2, then the lifter 11 will perform its lifting operation due to the flow of the pressure fluid from the pump 32 over the releasing valve 12 and the working conduit 107 and the stop valve 15 to the lifter 11. In the starting position of the releasing piston 16 pressure fluid can flow from the damping chamber 54 as well as from the control space 58 over the return conduit 62 to the tank 33. In this position the second piston section 65 of the releasing piston 16 closes further the connection from the inlet chamber 57 to the second annular groove 79 and therewith to the pressure valve 82. The pressure building up in the working conduit 107 can therefore not pass over the pressure valve 82 to the return conduit 62. The pressure prevailing in the forwarding chamber 56 further acts over the cross bore 76 onto the rear face of the closure member 74 and presses the latter tightly against the valve seat. The closure member 74 which is tightly guided in the first bore 69 prevents escape of pressure medium over the first bore 69 to the return conduit 62. Therefore no pressure fluid will be lost during the lifting process. The specific construction of the connection 83 and of the pressure valve 82 will assure that also in the neutral position of the control arrangement 10 and during idling of the pump 32 a sufficient pressure will be built up for the proper precontrol.

It will be understood that each of the elements described above, or two or more together, may also find a useful application in other types of control arrangement differing from the types described above.

While the invention has been illustrated and described as embodied in a control arrangement for lifting and lowering of an implement, it is not intended to be limited to the details shown, since various modifications and structural changes may be made without departing in any way from the spirit of the present invention.

Of course, various modifications are possible without deviating from the basic principle of the invention. Even though the arrangement of the pressure valve 82 in the connection 83 in the interior of the releasing piston 16 is especially advantageous, the elements may also be arranged in the housing of the control arrangement. Of course, the control arrangement 10 may be used not only for lifting or lowering of a plow, but other implements may also be controlled thereby. It is also possible to provide the precontrol stage 21 with valves which are not actuated by magnets as disclosed but which are actuated by other means known in the art.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be patented by Letters Patent is set forth in the appended claims:

1. A control arrangement for lifting and lowering an implement comprising a cylinder and a piston movable in said cylinder and defining in said cylinder to one side of said piston a compartment; linkage means between said piston and said implement for lifting the latter upon feeding of pressure fluid into said compartment and for lowering said implement upon discharge of pressure fluid from said compartment; a source of pressure fluid; a tank; first valve means; second valve means arranged downstream of said first valve means; conduit means comprising an inlet conduit leading from said source to said first valve means, a working conduit leading from said first valve means to said second valve means, a consumer conduit leading from said second valve means to said compartment, a discharge conduit leading from said first valve means to said tank and a return conduit leading from said second valve means likewise to said tank, said first valve means comprising a reversing valve having a reversing slide movable between a first position connecting said inlet conduit to said working conduit and a second position connecting said inlet conduit to said discharge conduit, said second valve means comprising a releasing valve and a stop valve coordinated therewith, said releasing valve having a damping chamber at one end, a control space at the other end and a releasing piston movable between a first position permitting flow of pressure fluid over a section of said working conduit downstream of said releasing valve to said stop valve and from the latter through said consumer conduit to said compartment to lift said implement and a second position connecting said compartment to said return conduit to lower said implement; a throttle means connecting said damping chamber to said return conduit; first and second control valve means respectively connected to said reversing and releasing valves for controlling movement of said reversing slide and of said releasing piston between the positions thereof; and pressure peak preventing means for preventing pressure peaks in the conduit means upstream of said releasing piston and comprising passage means connecting a portion of said working conduit upstream of said releasing valve with said damping chamber only when said releasing piston is in said second position and a pressure responsive valve in said passage means controlled in dependence on the pressure prevailing in said working conduit upstream of said releasing valve to communicate fluid from said working conduit to said damping chamber.

2. A control arrangement as defined in claim 1, wherein said releasing valve has adjacent said damping chamber an outlet chamber, and wherein said releasing piston has a first piston section arranged to connect in said first position of said releasing piston, in which said stop valve is separated from the return conduit and connected to the upstream section of said working conduit, said damping chamber with said outlet chamber and to interrupt in a position adjacent to the second position of said releasing piston the connection between said chambers, and wherein said throttle means defines a throttle connection between said chambers.

3. A control arrangement as defined in claim 2, wherein said passage means and said pressure responsive valve are arranged in said releasing piston.

4. A control arrangement as defined in claim 3, wherein said releasing valve has an inlet chamber communicating with said upstream section of said working conduit, wherein said releasing piston has a second piston section provided at its outer periphery with an annular groove, which in said first position of said releasing piston is separated from said inlet chamber and in positions deviating from said first position communicates with said inlet chamber, wherein said passage means includes an axial bore in said releasing piston forming a valve seat and a transverse bore connecting said groove with said axial bore upstream of said valve seat, and wherein said pressure responsive valve comprises a closure member and spring means biasing said closure member against said valve seat.

5. A control arrangement as defined in claim 4, wherein said passage means includes further an annular chamber surrounding said axial bore downstream of said valve seat and a second axial bore leading from said annular chamber to an end face of said first piston section.

6. A control arrangement as defined in claim 4, wherein said spring means biasing said closure member against said valve seat is a relatively weak spring, wherein said closure member is closely slidably guided in a portion of said first mentioned axial bore opposite from the portion with which said transverse bore communicates, and including a second transverse bore communicating in said second position of said releasing piston with said outlet chamber.

7. A control arrangement as defined in claim 4, wherein said reversing valve comprises an inlet chamber communicating with said inlet conduit, a first control chamber at one end thereof communicating with said control conduit and a second control chamber at the other end thereof communicating with said first control valve means, and a spring engaging said reversing slide and biasing the latter in opposition to the pressure in said first control chamber, whereby due to the force of said spring a low circulating pressure is established in said inlet chamber in said first position of said reversing slide, and wherein said spring means biasing said closure member against the valve seat is constructed to provide a force only slightly greater than said circulation pressure.

8. A control arrangement as defined in claim 1, wherein said source of pressure fluid is constituted by a pump.

* * * * *